United States Patent [19]

Benson

[11] 4,249,378

[45] Feb. 10, 1981

[54] THERMALLY ACTUATED HEAT PUMP

[76] Inventor: Glendon M. Benson, 463 Veda Dr., Danville, Calif. 94526

[21] Appl. No.: 71,470

[22] Filed: Aug. 31, 1979

Related U.S. Application Data

[63] Continuation-in-part of Ser. No. 937,902, Aug. 29, 1978, abandoned.

[51] Int. Cl.[3] ..... F01B 29/10; F25B 9/00; F02G 1/04

[52] U.S. Cl. ..... 60/525; 62/6

[58] Field of Search ..... 60/517, 520, 525, 526, 60/524; 62/6, 498, 510, 467, 500, 115

[56] References Cited

U.S. PATENT DOCUMENTS

| | | | |
|---|---|---|---|
| 2,986,907 | 6/1961 | Hoop | 62/510 |
| 3,552,120 | 1/1971 | Beale | 62/6 |
| 3,751,904 | 8/1973 | Rydberg | 60/525 |
| 4,044,558 | 8/1977 | Benson | 60/520 |

*Primary Examiner*—Lloyd L. King
*Attorney, Agent, or Firm*—Townsend and Townsend

[57] ABSTRACT

A thermal machine utilizing a positive displacement element which oscillates at a damped resonant frequency is disclosed. The positive displacement element controls the volume of expander and compressor subchambers. A heat exchanger is provided which includes a high temperature heat source, a low temperature heat source, and at least one heat sink. Valves control the flow of fluid into and out of the expander subchamber so that the subchamber acts to expand the fluid. A first working fluid is conducted through the expander subchamber, one of the heat sinks, a compressing device and the high temperature heat source in series. A second working fluid is conducted through the compressor subchamber, one of the heat sinks, an expanding device and the low temperature heat source in series.

29 Claims, 3 Drawing Figures

THERMALLY ACTUATED HEAT PUMP

This application is a continuation-in-part of my prior application entitled "RANKINE/RANKINE HEAT PUMP", Ser. No. 937,902 filed Aug. 29, 1978, now abandoned.

BACKGROUND OF THE INVENTION

This invention relates to thermally actuated machines which pump heat, without the intermediary conversion to shaft power, by employing freely oscillating positive displacement elements that subject working fluids to a thermodynamic cycle.

In energy conversion, it is often necessary to convert heat energy to pump heat for achieving a desirable temperature. It is further desirable to convert energy at as high an efficiency as possible, limited only by the First and Second Laws of Thermodynamics. It is further desirable that this be done by machines that are simple, compact, quiet and reliable and that are self-starting and self-regulating to load variations. The present invention meets these requirements and can be varied in configuration and function to match a wide range of output and performance requirements.

Broadly stated, the present invention relates to machines in which freely oscillating positive displacement mechanical elements periodically subject a working fluid to a thermodynamic cycle through continuous thermal energy interchange with the surroundings and thereby produce a net heating or cooling effect (heat pumping) without intermediary conversion to shaft work. The continuous thermal energy interchange (as opposed to the intermittent thermal energy interchange produced in spark or compression ignited combustion engines), casued by a temperature difference between a thermal source and sink, provides the driving potential through volume and pressure change (related by the equation of state of the working fluid) to produce the driving force for the oscillation of the positive displacement elements. As a result, whenever a temperature difference is impressed on this thermal machine, heat is pumped from a lower to a higher temperature thereby producing a cooling effect at the lower temperature and a heating effect at the higher temperature.

SUMMARY OF THE INVENTION

The present invention provides a thermal machine utilizing a positive displacement element which oscillates at a damped resonant frequency. The positive displacement element controls the volume of expander and compressor subchambers. A heat exchanger is provided which includes a high temperature heat source, a low temperature heat source, and at least one heat sink. Valves control the flow of fluid into and out of the expander subchamber so that the subchamber acts to expand the fluid. A first working fluid is conducted through the expander subchamber, one of the heat sinks, a compressing device and the high temperature heat source in series. A second working fluid is conducted through the compressor subchamber, one of the heat sinks, an expanding device and the low temperature heat source in series.

The present invention further provides a method of subjecting a first working fluid to a thermodynamic cycle to obtain work output which in turn is used to subject a second working fluid to a thermodynamic cycle to pump heat. The method comprises the steps of heating a first working fluid essentially at constant pressure; expanding the heated fluid in a valved, positive displacement expander; cooling the fluid at essentially a constant pressure; further cooling the fluid, at essentially a constant pressure, to a prescribed temperature; compressing the cooled fluid; heating the fluid at essentially a constant pressure; and completing the thermodynamic cycle by again heating the working fluid at essentially a constant pressure. The work produced by expansion of the first working fluid in the positive displacement expander compresses a second working fluid in a valved positive displacement compressor. This second fluid then is cooled at essentially constant pressure; expanded, which may provide the pump work for the first thermodynamic cycle; heated at essentially constant pressure; and then completes its thermodynamic cycle by again being compressed in a valved positive displacement compressor forming part of the expander of the first working fluid.

The first thermodynamic cycle is an engine cycle in which net work is produced. The second thermodynamic cycle is a heat pump cycle in which the net work produced by the first cycle pumps heat in the second cycle from a lower to a higher temperature. Work can be derived by applying a load to the oscillating positive displacement element. Moreover, the first working fluid can be compressed and the second working fluid expanded by an equivalent oscillating positive displacement element, and work can be derived from this element as well.

None of the patents found in the prior art illustrate apparatus which includes valved positive displacement elements which are free to oscillate at a damped resonant frequency and which directly compress a working fluid by the expansion of a separated working fluid where said compression and expansion elements are rigidly connected. The resonant positive displacement elements of the present invention provide variable stroking and damping to match the heat pump load. In contrast, the patent to Beale, U.S. Pat. No. 3,552,120 illustrates a valve-less, free-piston engine in which the pistons reciprocate randomly and asinusoidally and are therefore not valved, damped resonant oscillators. The patent to Benson, U.S. Pat. No. 4,044,558 describes a valved, free-piston engine in which the expander and compressor for the engine working fluid are rigidly coupled.

The principal features of this invention include: (1) self-starting and self-regulating to load with efficiency optimized for any heat pump load; (2) high efficiency which approaches Carnot efficiency as thermodynamic irreversibilities approach zero; (3) silent operation; (4) accepts a variety of heat sources including both low and high-temperature solar collectors as well as fossil fuel combustors, rejected process heat, and exhaust heat from conventional engines; (5) heat pump capacity which is modulated by varying stroke during operation of positive displacement oscillators; (6) functions as a total energy system which simultaneously supplies electrical power and heating or cooling effect for on-site consumption or for transport applications; (7) permits hermetic sealing of the machine owing to use of a stable working fluid and self-acting working fluid bearings; (8) permits flexibility in design, configuration, and construction to meet the range of applications.

The foregoing, together with other objects, features and advantages of the present invention will become more apparent after referring to the following specification and accompanying drawings in which:

DESCRIPTION OF THE PREFERRED EMBODIMENTS

Figure 1:
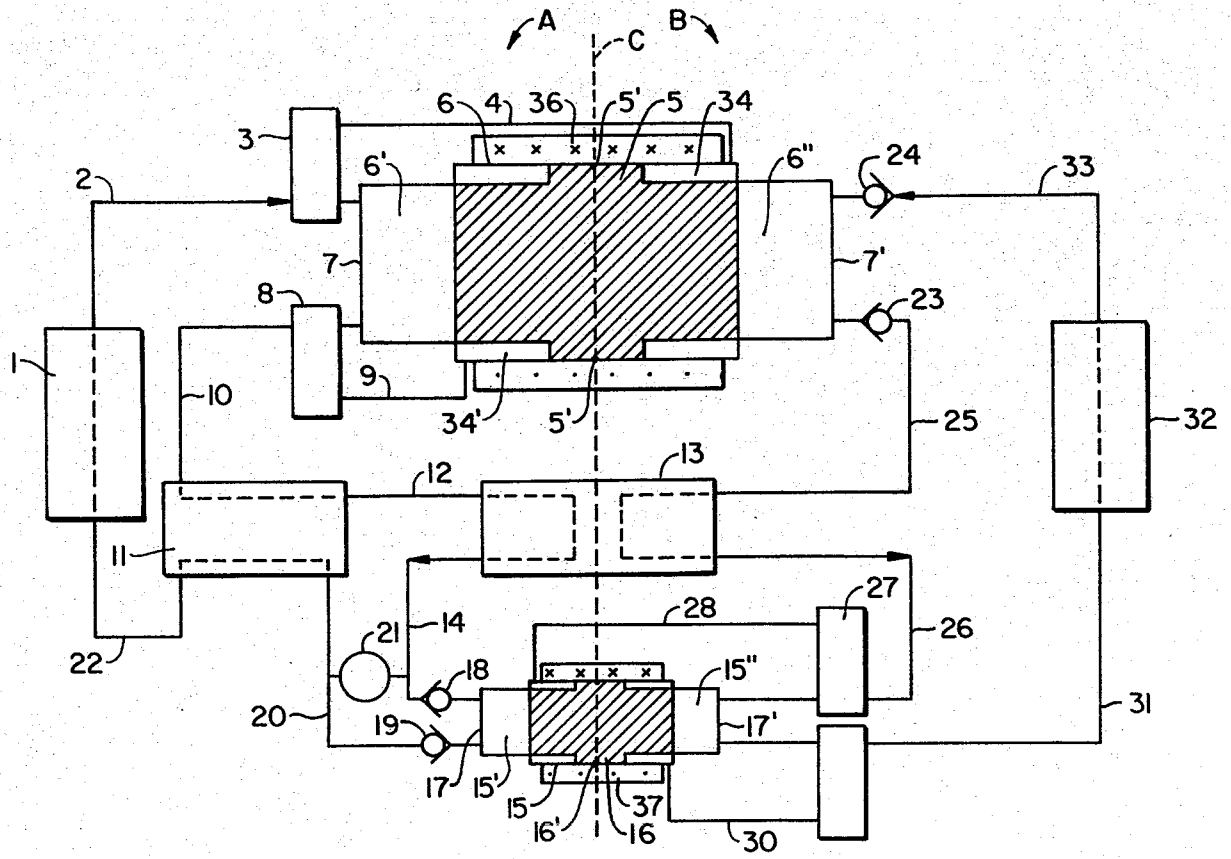
FIG. 1 is a schematic view of a preferred embodiment of a thermally actuated heat pump constructed according to the teachings of the present invention.

Referring more particularly to the drawings and specifically to FIG. 1, a preferred embodiment of the engine of the present invention is depicted substantially. The engine has two interrelated portions, a heat engine portion A and a heat pump portion B, separated by dashed line C in the figures.

In heat engine portion A a heat source 1 for the working fluid is connected by conduit 2 to intake valve 3, operated by actuator 4. Positive displacement element 5 is contained in cylinder housing 6 which is covered by cylinder head 7 to form an expander subchamber 6'. Intake valve 3 and exhaust valve 8 to subchamber 6' are operated by actuators 4 and 9, respectively. Conduit 10 connects exhaust valve 8 to regenerator 11 and conduit 12 connects regenerator 11 to heat sink 13, while conduit 14 connects heat sink 13 to pump cylinder 15. Positive displacement element 16 is contained in pump cylinder 15 and covered by cylinder head 17 to form a compressor section 15'. Head 17 contains intake valve 18, typically a check valve but possibly a controlled valve, and discharge check valve 19, joined to conduit 20. Bypass valve 21 connects conduits 14 and 20, which connects to regenerator 11. Conduit 22 connects regenerator 11 to heat source 1.

Heat pump portion B includes a compressor subchamber 6'' which contains the compressor section of the positive displacement element 5, sealed from the expander section by circumferential seal 5', and is covered by cylinder head 7' that houses intake check valve 24 and discharge check valve 23. In the embodiment shown, the cross-sectional area of compressor subchamber 6'' is equal to that of expander subchamber 6', but in certain applications different such areas may be preferable. Conduit 25 connects valve 23 to heat sink 13 and conduit 26 connects heat sink 13 to intake valve 27, operated by actuator 28. Positive displacement element 16 is contained in cylinder 15 and is sealed from the pump section by circumferential seal 16' to form an expander section 15''. Cylinder 15 is covered by cylinder head 17' that houses intake valve 27 and discharge valve 29, operated by actuators 28 and 30, respectively. Conduit 31 connects exhaust valve 29 to low temperature heat source 32 and conduit 33 connects source 32 to compressor subchamber 6'' through intake valve 24.

The operation of this configuration of the present invention can be appreciated by following the working fluids through the thermodynamic cycle of the heat engine and heat pump. Considering the heat engine section first, the heat source 1 heats the working fluid at essentially constant pressure. The heated fluid flows through conduit 2 to intake valve 3 which is opened and closed at prescribed times by valve actuator 4 so that subchamber 6' acts as an expander. Working fluid enters expander cylinder 6 through intake valve 3 when positive displacement element 5 is near left end-stroke. Working fluid flow continues to fill expander cylinder 6 at essentially constant pressure, while positive displacement element 5 moves away from left stroke-end, until intake valve 3 is closed by actuator 4 during the rightward stroke of element 5. The working fluid within expander cylinder 6 then expands as positive displacement element 5 continues to stroke rightward. At right stroke-end of positive displacement element 5, discharge valve 8 is opened by valve actuator 9 and the working fluid contained within expander subchamber 6' is discharged at essentially constant pressure through exhaust valve 8 as positive displacement element strokes leftward. As positive displacement element nears left end-stroke discharge valve 8 is closed by valve actuator 9. Working fluid, discharged at low pressure through discharge valve 8, flows through conduit 10 to regenerator 11 where the fluid is regeneratively cooled at essentially constant pressure. The working fluid flows from regenerator 11 through conduit 12 to heat sink 13 which cools the fluid to a prescribed temperature at essentially constant pressure. The cooled working fluid flows from heat sink 13 through conduit 14 to pump intake valve 18, which opens when positive displacement element 16 strokes rightward from left stroke-end. Working fluid fills pump cylinder 15 at essentially constant pressure as the positive displacement element 16 strokes rightward. As positive displacement 16 begins stroking leftward the working fluid pressure, contained in pump cylinder 15, is pressurized, opening pump discharge check valve 19 and discharging working fluid into conduit 20. Working fluid continues discharge at essentially constant pressure into conduit 20 until positive displacement element 16 reaches left stroke-end and begins stroking rightward, which reduces fluid pressure in cylinder 15 thereby closing discharge check valve 19 and opening intake check valve 18. Bypass throttling valve 21 returns a portion of working fluid, discharged into conduit 20, to conduit 18 to control discharge flow rate of working fluid through conduit 20 into regenerator 11. Alternately, pump inlet valve 18 may be modulated by controlling its open interval thereby regulating pump throughput into conduit 20. Working fluid so pressurized and flow-modulated, enters regenerator 11 through conduit 20, and is regeneratively heated at essentially constant pressure by heat exchange with the regeneratively cooled working fluid entering regenerator through conduit 10. The working fluid so heated in regenerator 11 flows through conduit 22 to heat source 1, thereby completing the thermodynamic cycle of the engine working fluid.

Considering the heat pump next, the working fluid, contained in compressor subchamber 6'', is compressed as the positive displacement element 5 strokes rightward. At a prescribed pressure compressor discharge check valve 23 opens and discharges the pressurized working fluid at essentially constant pressure into conduit 25. This discharge flow continues until positive displacement element 5 completes rightward stroking and begins leftward stroking, which reduces working fluid pressure in subchamber 6'' causing discharge check valve 23 to close and intake check valve 24 to open. Working fluid so compressed flows through conduit 25 to heat sink 13 where it is cooled at essentially constant pressure to a prescribed temperature. The cooled working fluid flows from heat sink 13 through conduit 26 to expander intake valve 27, which is opened by valve actuator 28 when positive displacement element 16 is stroking leftward. Working fluid flows into expander section 15" at essentially constant pressure. At a prescribed time, valve actuator 28 closes intake valve 27, which then permits working fluid in section 15" to expand and thereby drive positive displacement element 16 leftward. As positive displacement element 16 strokes rightward, discharge valve 29 is opened by valve actuator 30, and expanded working fluid contained in section 15" is discharged at essentially constant pressure through discharge valve 29 into conduit 31. Discharge flow into conduit 31 continues at essentially constant pressure until positive displacement element 16 reaches right stroke-end, at which time valve actuator 30 closes discharge valve 29. The discharged expanded working fluid flows through conduit 31 to low temperature heat source 32 where the working fluid, at essentially constant pressure, absorbs heat. The working fluid then flows from heat sink 32 through conduit 33 to compressor intake valve 23, thereby completing the thermodynamic cycle of the heat pump working fluid.

The above described thermodynamic cycle for the working fluids corresponds to a regenerative Brayton cycle if single phase (gaseous) working fluids are used, and a regenerative Rankine cycle if phase-change (liquid-gaseous) working fluids are used. By employing isothermalizers in variable volume cylinder chambers 6 and 15 the working fluid contained in each of these chambers is maintained at essentially the constant temperature of the respective cylinder, thereby increasing efficiency and power density of the machine.

Positive displacement element seals 5' and 16' are exclusion seals if the engine working fluid differs from the heat pump working fluid, whereas these seals are either narrow-clearance seals or rubbing seals if the engine working fluid is the same as the heat pump working fluid. Limited exchange of the working fluids is acceptable if they have the same composition, and limited flow of the working fluids over the positive displacement elements 15, 16 can serve to lubricate them.

Intake and discharge valve actuators 4 and 9 are operated by the pressure variation in seal chambers 34 and 34' respectively, and valve actuators 28 and 30 are operated by the pressure variation in seal chambers 35 and 35', respectively. These actuators are described in U.S. Pat. No. 4,044,558. Alternately, these valve actuators may be electromagnetically operated as described in U.S. Pat. No. 3,772,540, and therefore may be controlled by a microprocessor.

The embodiment of this invention shown in FIG. 1 employs linear electric machines 36 and 37 which circumscribe cylinders 6 and 15, respectively. Linear electric machine 36 functions as a linear alternator when work produced by engine working fluid in subchamber 6' exceeds that of work absorbed by heat pump working fluid in subchamber 6", and functions as a linear motor when engine work output is less than heat pump work absorbed. Linear electric machine 37 similarly balances pump work performed in section 15' and expander work performed in section 15".

Linear electric machine 36 permits this heat actuated heat pump invention to generate AC electricity and to be capacity augmented by electric power when load conditions require additional power input. As a result, this invention exhibits a dual energy source capability in which both thermal energy (at heat source 1) and electric power may be used for operation.

Figure 2:
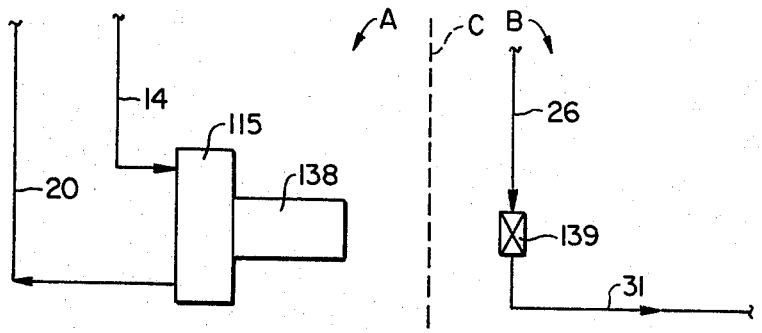
FIG. 2 illustrates a modification of the embodiment shown in FIG. 1.

The configuration shown in FIG. 1 may be modified as shown in FIG. 2 in which the same reference numerals are used to refer to equivalent parts. Pump section 15' is replaced by pump 115 which connects intake conduit 14 to pump charge conduit 20. Pump 115 is driven by pump drive 138. Expander section 15" is replaced by expansion valve 139 which connects expander intake conduit 26 to expander discharge conduit 31.

The operation and function of this configuration is similar to that shown in FIG. 1. Pump 115 pressurizes engine working fluid from the low pressure in pump intake conduit 14 to the high pressure in pump discharge conduit 20, with pump 115 driven by pump driver 138, exemplified by a hermetically-sealed electric motor. Similarly, expansion valve 139 expands heat pump working fluid from the high pressure in expander intake conduit 26 to the low pressure in expander discharge conduit 31.

Figure 3:
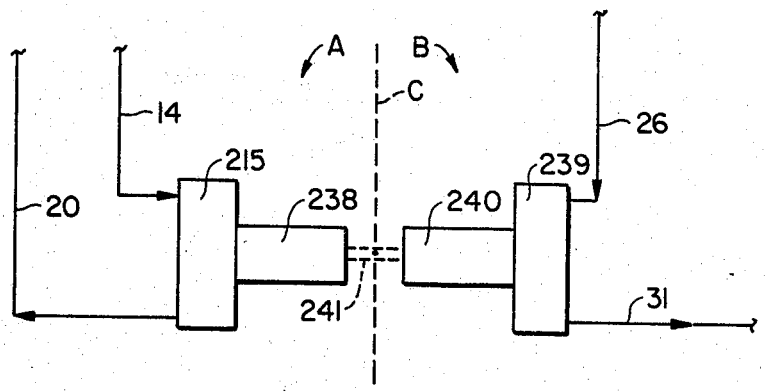
FIG. 3 illustrates another modification of the embodiment shown in FIG. 1.

The configuration shown in FIG. 1 also may be modified as shown in FIG. 3 (again using the same reference numerals for equivalent parts) by replacing pump cylinder 15 by pump 215 which connects pump intake conduit 14 to pump discharge conduit 20 and where pump 215 is driven by pump driver 238, and in addition expander section 15" is replaced by expander 239 which connects expander intake conduit 26 to expander discharge conduit 31 and where expander 239 drives expander load 240.

The operation and function of this configuration is again similar to that shown in FIG. 1. Pump 215 pressurizes engine working fluid from the low pressure in pump intake conduit 14 to the high pressure in pump discharge conduit 20, with pump 215 driven by pump driver 238, exemplified by a hermetically-sealed electric motor. Similarly, expander 239 expands heat pump working fluid from the high pressure in expander intake conduit 26 to the low pressure in expander discharge conduit 31, with expander 239 driving expander load 240, exemplified by a hermetically-sealed electric generator. It is obvious that in this modification the power output from expander load 240 can be connected to pump driver 238 by connection means 241.

Peformance of the thermal machine shown in FIG. 1 may be optimized by selecting appropriate working fluids. For phase change fluids the working fluids that exhibit the highest performance for a two-fluid embodiment are toluene for the engine and R-22 for the heat pump. With these fluids and a high temperature heat source temperature of 350° C., a cooling coefficient of performance (COP) of 0.8–1.0 and a heating COP of 1.3–1.5 at standard rating conditions are theoretically calculated. Substituting R-133 for the engine working fluid and operating the high temperature heat source at 180° C. reduces these COP values to about 70 percent and 80 percent of the respective values of toluene. For a single phase-change working fluid the fluid that produces the highest COP values is R-142. Operating at a high temperature heat source temperature of 180° C. yields a cooling COP of 0.6 and a heating COP of 1.2 under standard rating conditions.

Thus it will be seen that the present invention provides an extremely useful, desirable and efficient thermally actuated heat pump in which the positive displacement elements freely oscillate at a damped resonant frequency and vary their stroke to match the heat pump load (whether cooling or heating load), to optimize efficiency at a given load and to self-start. Further, the use of freely oscillating positive displacement elements provides the means for using working fluid self-acting gas bearings for support and sealing which permit the hermetic sealing of the working fluid in a compact, high-capacity machine. These features combine to form the basis for a machine that is quiet, simple and reliable and that can be configured in a number of embodiments to provide cooling, heating and electrical power generation and power augmentation having a versatility of applications. The invention can be incorporated into reciprocating, rotating, or other forms of mechanical positive displacement oscillators without sacrificing the advantages alluded to hereinabove.

Although several embodiments of the invention have been shown and described, it will be obvious that other adaptations, modifications and configurations can be made without departing from the true spirit and scope of the invention with such adaptations and modifications including cascaded refrigeration, and combinations of additional loads to the principal embodiments of the invention herein described.

I claim:

1. A thermal machine comprising:

a positive displacement element which oscillates at a damped resonant frequency;

means for defining expander and compressor subchambers having volumes controlled by the positive displacement element;

heat exchange means including a high temperature heat source, a low temperature heat source, and at least one heat sink;

valve means for controlling the flow of fluid into and out of the expander subchamber so that said subchamber expands fluid therein;

means for compressing a fluid;

a first working fluid cycled in series through the expander subchamber, one of said heat sinks, the compressing means, the high temperature heat source and back to the expander subchamber to subject the first working fluid to a thermodynamic cycle comprising expansion, cooling, compression and heating steps;

means for expanding a fluid; and a second working fluid cycled in series through the compressor subchamber, one of said heat sinks, the expanding means, the low temperature heat source and back to the compressor subchamber to subject said second working fluid to a thermodynamic cycle comprising compression, cooling, expansion and heating steps.

2. A thermal machine as recited in claim 1 wherein the defining means comprises a chamber, and wherein the positive displacement element oscillates within said chamber to divide the opposite ends of said chamber into expander and compressor subchambers respectively.

3. A thermal machine as recited in claim 1 and additionally comprising a regenerator, and wherein the first working fluid is cycled through the regenerator between the expander subchamber and its associated heat sink, and between the compressing means and the high temperature heat source.

4. A thermal machine as recited in claim 1 wherein the compressing means comprises a pump.

5. A thermal machine as recited in claim 1 wherein said compressing means and said expanding means jointly comprise a housing, and a free-floating piston which oscillates in said housing at a damped resonant frequency and divides the interior volume of the housing into expansion and compression subchambers providing expanding and compressing means respectively.

6. A thermal machine as recited in claim 1 wherein the expanding means comprises an expansion valve.

7. A thermal machine as recited in claim 1 wherein the expanding means drives the compressing means.

8. A thermal machine as recited in claim 1 wherein the defining means comprises a cylinder having an enlarged center portion and smaller end portions, and wherein the positive displacement element is a piston having an enlarged center portion and smaller end portions conformed to the dimensions of the cylinder.

9. A thermal machine as recited in claim 8 wherein the end portions of the cylinder have the same cross-sectional area.

10. A thermal machine as recited in claim 8 wherein the small chambers defined by the small ends of the piston and the large center portion of the cylinder control the valve means.

11. A thermal machine as recited in claim 8 wherein the small chambers defined by the ends of the piston and the center of the cylinder are gas spring chambers to provide a spring force for the resonant oscillation of the positive displacement element.

12. A thermal machine comprising:

a housing;

a positive displacement element which oscillates within the housing and divides the interior volume of the housing into expander and compressor subchambers;

valve means controlling influx and eflux to the expander subchamber so that said expander subchamber expands fluid therein;

heat exchange means including a high temperature heat source, a low temperature heat source, and at least one heat sink;

a pump having compression and expansion components, the expansion component driving the compression component;

a first working fluid recycled in series through the high temperature heat source, the expander subchamber, one of the heat sinks, the compression component of the pump and back to the high temperature heat source to subject the first working fluid to a thermodynamic cycle comprising expansion, cooling, compression and heating steps; and a second working fluid cycled in series through the compressor subchamber, one of said heat sinks, the expansion component of the pump, the low temperature heat source and back to the compressor subchamber to subject said second working fluid to a thermodynamic cycle comprising compression, cooling, expansion and heating steps.

13. A thermal machine as recited in claim 12 wherein the pump includes a pump housing, and a positive displacement pump element which oscillates within the pump housing and divides the interior volume of the housing into compression and expansion subchambers.

14. A thermal machine as recited in claim 12 wherein the pump includes an electrical generator powered by the expansion component, and an electrically powered pumping unit driving the compression component using the power supplied by the generator.

15. A thermal machine as recited in claim 12 and additionally comprising a bypass valve allowing a controlled portion of the first working fluid to bypass the pump to provide a throttle control.

16. A thermal machine as recited in claim 1 or 12 and additionally comprising means for deriving work output from the movement of the positive displacement element.

17. A thermal machine as recited in claim 16 wherein said deriving means comprises a linear electric machine circumscribing the positive displacement element.

18. A thermal machine as recited in claim 1 or 12 wherein said positive displacement element has variable displacement.

19. A thermal machine as recited in claim 1 or 12 wherein the valve means is adjustable to vary the expansion step of the thermodynamic cycle of the first working fluid.

20. A thermal machine comprising:

a pair of positive displacement elements which oscillate at a damped resonant frequency;

means for defining a first and second pair of expander and compressor subchambers having volumes controlled by the respective positive displacement elements;

heat exchange means including a high temperature heat source, a low temperature heat source, and a heat sink;

valve means for controlling the flow of fluid into and out of the expander subchambers so that said subchambers expand the fluid therein;

a first working fluid cycled in series through the first expander subchamber, the heat sink, the second compressor subchamber, the high temperature heat source and back to the first expander subchamber to subject the first working fluid to a thermodynamic cycle comprising expansion, cooling, compression and heating steps; and a second working fluid cycled in series through the first compressor subchamber, the heat sink, the second expander subchamber, the low temperature heat source and back to the first compressor subchamber to subject said second working fluid to a thermodynamic cycle comprising compression, cooling, expansion and heating steps.

21. A thermal machine as recited in claim 1, 12 or 20 wherein the first and second working fluids are identical.

22. A thermal machine as recited in claim 21 and including means for allowing limited fluid communication of the first and second working fluids between the expander and compressor subchambers.

23. A thermal machine as recited in claim 1, 12 or 20 wherein the working fluids lubricate the positive displacement elements.

24. A thermal machine as recited in claim 1, 12 or 20 wherein the first and second working fluids are different from one another.

25. A thermal machine as recited in claims 1, 12 or 20 wherein the working fluids at least partially liquify during portions of their cycles.

26. A method for obtaining work output and pumping heat comprising the steps of:

subjecting a first working fluid to a thermodynamic cycle including, in series, heating the first working fluid at a substantially constant pressure, expanding the heated fluid in a valved positive displacement expander, cooling the fluid at a substantially constant pressure to a prescribed temperature, compressing the cooled fluid, and heating the fluid at a substantially constant pressure; and subjecting a second working fluid to a thermodynamic cycle comprising, in series, compressing the second working fluid in a valved positive displacement compressor driven by the work produced by the expansion of the first working fluid, cooling the compressed fluid at a substantially constant pressure, expanding the fluid, and heating the fluid at a substantially constant pressure, whereby work can be obtaind from the movement of the expander and heat pump effect obtained from the cooling portions of the cycles.

27. A method as recited in claim 26 and additionally comprising the step of deriving work output from the movement of the positive displacement expander.

28. A method as recited in claim 26 and additionally comprising the steps of deriving work output from the expanding of the second working fluid.

29. A method as recited in claim 26 wherein expanding the second working fluid includes driving a pump to compress the first working fluid.

* * * * *